United States Patent [19]

Tomasch et al.

[11] 4,281,558

[45] Aug. 4, 1981

[54] FUEL INJECTION PUMP CONTROL LEVER CONSTRUCTION

[75] Inventors: Hellmut Tomasch, Freiberg; Robert Bacher, Stuttgart; Karl Konrath, Ludwigsburg; Claus Köster, Ditzingen; Heinz Nothdurft, Stuttgart, all of Fed. Rep. of Germany

[73] Assignee: Robert Bosch GmbH, Stuttgart, Fed. Rep. of Germany

[21] Appl. No.: 26,741

[22] Filed: Apr. 3, 1979

[30] Foreign Application Priority Data

May 26, 1978 [DE] Fed. Rep. of Germany ..... 2823113

[51] Int. Cl.[3] ..... F02D 1/04; F02M 59/24

[52] U.S. Cl. ..... 74/99 R; 29/432; 123/445

[58] Field of Search ..... 74/99 R, 102, 108; 123/139 BD, 140 R, 139 AL; 29/432

[56] References Cited

U.S. PATENT DOCUMENTS

| | | | |
|---|---|---|---|
| 3,946,713 | 3/1976 | Laufer | 123/139 BD X |
| 3,970,064 | 7/1976 | Eheim et al. | 123/140 R X |
| 3,974,812 | 8/1976 | Konrath | 123/140 R X |
| 3,974,814 | 8/1976 | Eheim | 123/140 R X |
| 4,044,443 | 8/1977 | Chartet | 29/432 X |

FOREIGN PATENT DOCUMENTS

| | | | |
|---|---|---|---|
| 243134 | 9/1962 | Australia | 74/102 |
| 1069936 | 11/1959 | Fed. Rep. of Germany | 123/140 R |
| 33487 | 1/1909 | Sweden | 123/140 R |
| 943393 | 12/1963 | United Kingdom | 29/432 |

OTHER PUBLICATIONS

Bosch Technical Bulletin 46, VDT-1-460/1B, Supplement 1, Sep. 1976.

*Primary Examiner*—Lawrence J. Staab

*Attorney, Agent, or Firm*—Frishauf, Holtz, Goodman & Woodward

[57] ABSTRACT

To provide a surface of wear-resistant material on the start lever of a lever assembly for a fuel injection pump control apparatus, a headed bolt of hardened, wear-resistant material is punch-pressed into a plate-like portion of the lever being engaged by a positioning element so that continuous movement of the positioning element with respect to the lever will not wear out the engagement surface and thus change a preset position of the positioning element with respect to the engagement surface of the lever, while permitting the lever to be made of a material suited for its purpose without regard to the particular surface characteristics of the engagement surface with the positioning element.

8 Claims, 2 Drawing Figures

FUEL INJECTION PUMP CONTROL LEVER CONSTRUCTION

Figure 1:
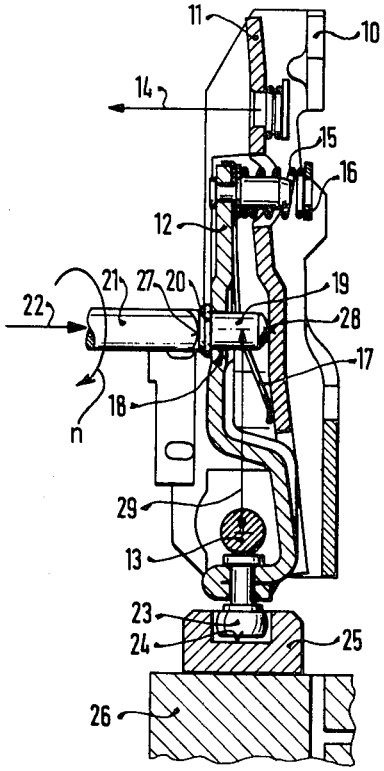

The present invention relates to a fuel injection pump control lever construction, and more particularly to a control assembly construction which has reduced wear in operation, so that the operating relationship between the control lever and the displacement of a positioning element will be essentially unvarying throughout the life of the apparatus.

BACKGROUND AND PRIOR ART

Fuel injection pumps have control levers which are engaged by a positioning element, typically a push rod. The push rod can be part of a centrifugal controller and thus both rotate as well as move axially. The engagement area between the push rod and the control lever as such is subject to wear.

In one arrangement of control levers, tensioning lever and a start lever are pivotable about a common axis which axis is pivoted in an adjustment lever structure which, in turn, is pivotably secured in the housing for the fuel injection pump. In operation, the housing is filled with the fuel to be injected. The tensioning lever can be positioned within a positioning lever by means of a control spring. The positioning element, is in continuous engagement with the start lever. The positioning element may be in form of a rod or bushing which is in engagement with the start lever. A spring between the tensioning lever and the start lever causes continuous engagement between the start lever and the positioning element.

The engagement surfaces of a start lever with the positioning element, usually are made of the same material as the lever itself. The start lever typically is a drawn steel element or a pressure cast element. Although the materials used for the start lever can be quite hard, the engagement surface is still subject to excessive wear upon continuous rotary and axial movement. The increased wear of the engagement surface of the continuously rotating positioning element with the surface of the start lever may change the respective positional relationship of the start lever with respect to the positioning element and thus may introduce an undesirable bias tolerance, that is, an undesired, uncontrolled mislocation of the start lever which may cause decrease of the fuel being injected by the fuel pump due to inaccurate control of the quantity of fuel. This inaccurate control may be due to shift of the position of the start lever due to such wear.

THE INVENTION

It is an object to so construct the start lever that the positional relationship between the command unit, typically the positioning element, and the start lever is accurately maintained for long periods of time.

Briefly, the engagement surface on the start lever engaged by the positioning element comprises wear-resistant material, and in accordance with a preferred embodiment, a separate bolt of highly wear-resistant material is punch-fitted into the material of the start lever itself. The bolt, preferably, is a headed bolt and the positioning element bears against the head thereof, which can be made of extremely hard, wear-resistant material.

The head itself can be set into the start lever which, typically, is a drawn sheet steel element, or other materials like aluminium, brass etc. by using the bolt as the punch of a punch element. The start lever is placed over the edge of a cavity die of a punch and the headed bolt is pressed through the material of the start lever as such thus, in one operation, effecting punching of the hole in which it is to be seated and, simultaneously, seating the headed bolt in the material of the start lever.

The arrangement provides for long, trouble-free and positionally accurate engagement of the positioning element with the start lever. It permits manufacture of the start lever from a material which is most suitable therefor while that portion of the start lever which is subject to increased wear is made of a material which is particularly suited to accept the increased wear—the hardened bolt.

Utilizing the bolt directly as a punch element to punch its own hole into the start lever while seating it substantially decreases the manufacturing costs of the overall assembly since boring the positioning hole for the bolt, with high positional accuracy, can be eliminated. No pilot hole need to be drilled, and the position of the start lever in a punch can be rapidly and quickly determined with great accuracy. An entire manufacturing step—drilling and boring the opening for a hardened bolt—is thus eliminated. The necessary testing of the position of a predrilled hole is also eliminated; and testing of the complete connection of the bolt to the start lever is also decreased since utilizing the bolt itself as the punch tool has a high degree of attachment reliability; there are no tolerances between the size of the bore or opening in which the bolt is to fit and the bolt itself, since the bolt makes its own hole; thus, the seating tolerances tend to zero or null. This has substantial advantages with respect to the overall quality in regard to other methods of attachment of the bolt to the start lever, since a high degree of uniformity of holding forces is obtained. Quality control is thus substantially simplified and it has been found that, statistically, the overall reject rate is substantially diminished.

DRAWINGS, ILLUSTRATING A PREFERRED EMBODIMENT

Figure 2:
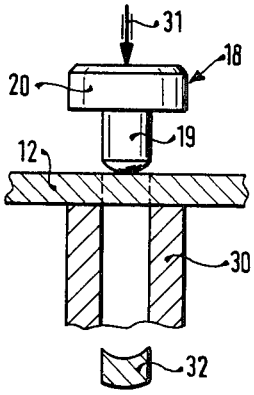

FIG. 1 is a fragmentary longitudinal sectional view through a control lever assembly for a fuel injection pump; and FIG. 2 is a highly schematic illustration of the start lever placed in a punch press to show the seating method for the hardened bolt.

The control lever assembly for a fuel injection pump is generally shown in FIG. 1, in which only those portions of the control lever assembly and of the fuel pump are illustrated which are necessary for an understanding of the present invention. For a more complete showing of the fuel injection pump and its control lever, reference is made to the U.S. patent application Ser. No. 916,312, filing date June 16, 1978 "RPM Regulator for Injection Pumps" now U.S. Pat. No. 4,208,999. The control lever assembly of FIG. 1, in general, is located within the housing of an injection and distribution pump and is formed of a double-arm positioning lever 10, a single-arm tensioning lever 11 and a double-arm start lever 12. The starting lever 12 and the tensioning lever 11 are pivotable about an axis 13 which is secured in lateral side walls of the positioning lever 10. The tensioning lever 11 is subjected to a tension force, for example by a spring, acting in the direction of the arrow 14 which symbolizes the tension force, which can be controlled by a control lever spring. An adjustment 15 is located between the end portion of the start lever 12 and a tab or flap 16 formed in the tensioning lever 11 to permit the zero adjustment of the position of the start lever. A leaf spring 17 spaces the start lever 12 from the tensioning lever 11.

A control or positioning element 21, in form of a rod or sleeve, preferably closed at the end, which may be formed with a slightly convex surface at the end, bears against the start lever 12 and positions the start lever.

In accordance with the present invention, the engagement surface between the start lever 12 and the positioning bolt 21 is made of hardened, wear-resistant material. As shown, a bolt 18 with a shaft 19 and a head 20 is set into the start lever 12 at that position where the positioning element 21 engages the start lever 12. The positioning element 21 is held in engagement with the start lever 12 by a bias force, symbolically illustrated by arrow 22. Upon deflection of the positioning bolt 21 to the right—FIG. 1—the force 22, of course, is increased. As explained in detail in the referenced application Ser. No. 916,312, bolt 21 forms the end portion of a sleeve which is part of a rotating element of a centrifugal governor as schematically indicated by arrow n.

The second arm of the start lever 12 is formed by a headed pin 23 which, at the bottom, is formed with a generally spherical portion to fit into a groove 24 of a control regulating collar or slider 25. The control slider 25 is movable on a distribution piston plunger or 26 in accordance with the position of the start lever 12 to thereby control the flow of fluid through ducts in the piston 26 and thereby adjust the effective fuel supply of the pump required to operate an associated engine in the range from idling to full load, and additionally under starting conditions.

The head 20 of the bolt 18 forms the engagement surface 27 for the positioning bolt or sleeve or, generally, control element 21. The shaft 19 of the bolt 18 is so dimensioned that it forms at its far end a positioning surface 28 for the bias lever 11. The distance between the axis of the bolt 18 and the pivot axis of the cross pin 13 is held small and, in accordance with a feature of the invention, so small that the bearing forces of the entire assembly, and particularly the bearing forces of the tensioning lever 11 are increased to such an extent that axial play about the cross pin 13 is essentially eliminated.

In accordance with a feature of the invention, the bolt 18 is accurately seated in the start lever 12 in a single simple operation. Referring to FIG. 2: The start lever 12, which is a plate-like element bent into suitable shape, possibly with lateral flanges to increase stiffness, is placed over the opening of a receiving punch element 30. The bolt 18 is used itself as the punch tool, and is guided to a predetermined punching position on the start lever 12. This can easily be obtained by placing the punch lever 12 in a suitable positioning die opposite the jig 30. A punch force, indicated by arrow 31, is then applied to the bolt 18; the bolt 18 will punch out a punch disk 32 from the lever 12 as it seats the bolt in the material of the start lever 12. The force 31 is applied to the bolt 18 until the head 20 of the bolt is in close engagement with the upper surface—as seen in FIG. 2—of the start lever 12. The holding force of the bolt 18 within the lever 12 is substantial; the punch connection is secure due to the frictional force around the hole formed by the shaft 19 in the start lever 12. The level of pressure, and thus the level of the axial holding force, is influenced by the roughness of the surface of the shaft 19, the bowing of the free end surface of the shaft at the lower end, that is, at the end forming the surface 28, the transition radius at the edge of the lower end of the bolt 19, that is, between the surface 28 and the overall diameter, and the cross-sectional area of the bolt 19, as well as by the play of the bolt 19 with respect to the diameter of the opening of the punch matrix or punch die 30.

The foregoing parameters can be changed within wide limits, and axial holding forces up to 20% of the theoretically obtainable cutting forces can be obtained; preferably, they are in the order of about 150 kilo ponds (kg/force).

The bolt 18 is made of a hard, wear-resistant material, for example: high wear-resistant hard-steel.

We claim:

1. Fuel injection pump control lever construction having a rotatable and axially movable positioning element (21);

a control lever assembly including a movable start lever (12) connected to and controlling the position of a fluid distribution element (25, 26) and formed as a plate or sheet-like element, means (13) movably positioning the start lever, and resilient means (15, 17, 22) engaging said start lever to maintain resilient contact thereof with the positioning element (21)

wherein, in accordance with the invention, the engagement surface on the control lever (12) engaged by the positioning element (21) comprises a bolt (18) of wear-resistant material punch-pressed into the plate-like element forming the start lever, an end portion (20) thereof forming a wear-resistant surface for engagement by said rotatable positioning element (21).

2. Construction according to claim 1 wherein the end portion comprises a bolt head (20) having said surface (27) which is wear-resistant.

3. Construction according to claim 2, wherein said bolt (18) comprises high wear-resistant hard-steel.

4. Construction according to claim 2, wherein the control lever assembly further includes a tensioning lever (11);

the resilient means (15, 17) maintaining said tensioning lever and said start lever in resiliently spaced mutual engagement;

and wherein the bolt (18) has a shank (19) dimensioned to have an end surface (28) remote from the head (20) thereof which forms a fulcrum point and engagement surface for the tensioning lever (11).

5. Construction according to claim 1, wherein the means positioning the start lever comprises a pivot pin (13) having a pivot axis spaced from said engagement surface and pivotally mounting said lever assembly, wherein the distance (29) between the center of the surface of wear-resistant material and said pivot pin (13) is small in relation to the forces transferred to eliminate axial play of pivoting movement about said pivot pin (13) of said assembly.

6. Construction according to claim 2, wherein the means positioning the start lever comprises a pivot pin (13) having a pivot axis spaced from the axis of said bolt (18) and pivotally mounting said lever assembly, wherein the distance (29) between the axis of said bolt (18) and the pivot pin (13) is small in relation to the forces transferred to eliminate axial play of pivoting movement about said pivot pin of said assembly.

7. In a fuel injection pump control lever construction having a rotatable and axially movable positioning element (21);

a control lever assembly including a movable control lever (21) having a plate or sheet-like portion, connected to and controlling the position of a fluid distribution element (25, 26), a retaining element (11) movably retaining said control lever, resilient means (15, 17) engaging said control lever for resilient contact thereof with the positioning element, and a bolt (18) of wear-resistant material secured to the control lever (12) to provide a surface of wear-resistant material for engagement with the rotatable and axially movable positioning element (21), a method to secure said bolt (18) to said plate-like portion of the control lever, comprising placing the plate-like portion of the control lever in the region of the attachment of said bolt to the lever over a cavity die (30);

and punch-fitting the bolt into the lever by punching out a punch disk by the bolt and utilizing said bolt as the punch element to simultaneously punch the opening into the plate-like portion of said control lever (12) while seating the bolt therein and retaining the bolt in the thus formed opening.

8. Method according to claim 7, wherein the bolt (18) is a headed bolt having a shank (19) and a head (20);

and wherein said punching-and-seating operation comprises pressing the shank (19) into and through said portion of the control lever (12) and seating the head against the plate-like portion of the control lever.

* * * * *